United States Patent [19]

Merser et al.

[11] 3,931,667

[45] Jan. 13, 1976

[54] INTERLOCKING ATTACHMENT DEVICE

[75] Inventors: Francis G. Merser, Framingham Center; Philip A. Kooistra, Northbridge, both of Mass.

[73] Assignee: Dennison Manufacturing Company, Framingham, Mass.

[22] Filed: May 8, 1974

[21] Appl. No.: 467,918

[52] U.S. Cl. ..... 24/150 FP; 292/322

[51] Int. Cl.[2] ..... B65D 55/06; A44B 9/00

[58] Field of Search..... 24/150 FP, 73 PF, 16 PB, 24/30.5 P, 217, 206 A, 208 A; 292/317, 292/321, 322, 307 R

[56] References Cited

UNITED STATES PATENTS

| | | | |
|---|---|---|---|
| 1,558,960 | 10/1925 | Brune | 292/317 |
| 3,103,666 | 9/1963 | Bone | 24/150 FP UX |
| 3,273,705 | 9/1966 | Rieger et al. | 24/150 FP UX |
| 3,285,404 | 11/1966 | Spinney | 24/16 PB UX |
| 3,302,917 | 2/1967 | Winkler | 24/73 PF UX |
| 3,416,200 | 12/1968 | Daddona | 24/208 A |
| 3,466,077 | 9/1969 | Moberg | 292/322 |
| 3,600,027 | 8/1971 | Noland et al. | 24/16 PB X |
| 3,712,655 | 1/1973 | Fuehrer | 292/321 |
| 3,753,586 | 8/1973 | Patterson | 292/322 |
| 3,757,389 | 9/1973 | Wiland | 24/217 X |

FOREIGN PATENTS OR APPLICATIONS

| | | | |
|---|---|---|---|
| 268,500 | 10/1963 | Australia | 24/208 A |

*Primary Examiner*—Donald A. Griffin
*Attorney, Agent, or Firm*—George E. Kersey

[57] ABSTRACT

An attachment device comprising a filament having a laterally oriented bar at one end and a hollow body member at its other end, a wall of said body member having an opening therethrough large enough to receive the filament and the bar when they are in parallel orientation but of a width smaller than the length of the bar so as to prevent the withdrawal of the bar from the hollow interior subsequent to insertion, a self-contained, interlocked attachment thereby being obtained.

14 Claims, 10 Drawing Figures

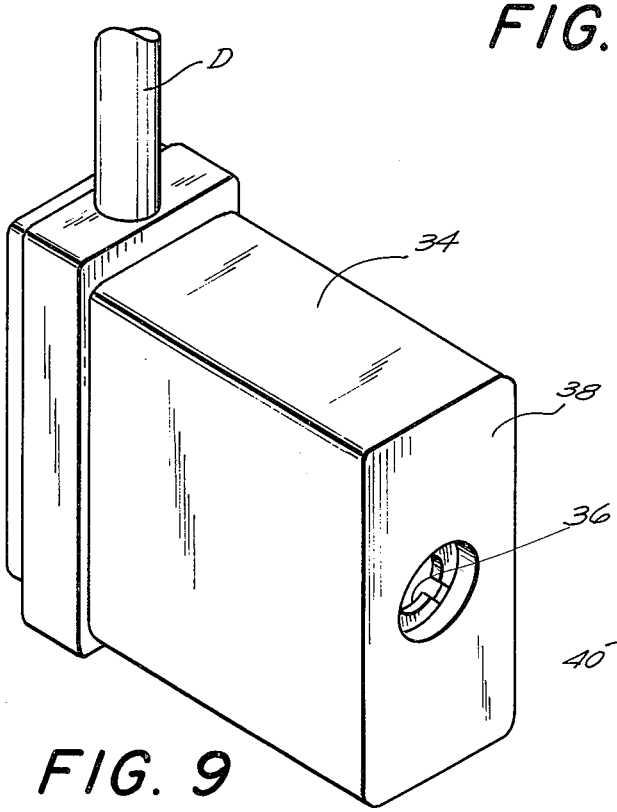
FIG. 9
FIG. 8
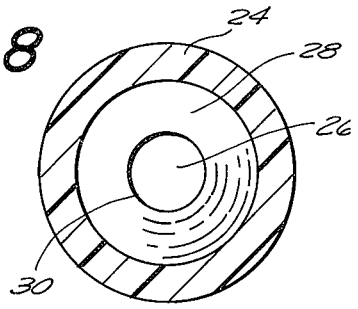
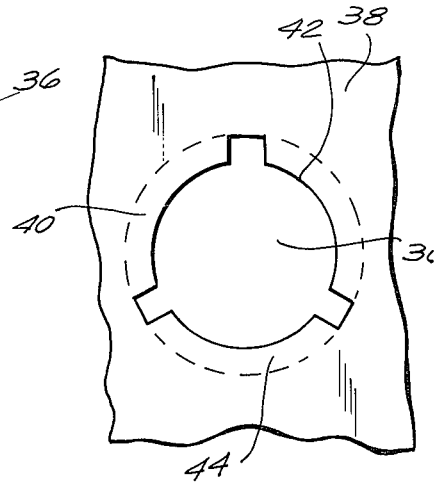
FIG. 10

INTERLOCKING ATTACHMENT DEVICE

This invention relates to attachments of a type designed to be inserted through an object usually with a view to attaching two objects together, and widely used to fasten tags or labels to garments or the like, with a very high degree of security, and to ways of using them. It also relates to an assembly of such attachments which greatly facilitates the application of such attachments to the objects with which they are to be associated.

Attachments of the general type here involved have been previously disclosed in Bone U.S. Pat. No. 3,444,597, issued May 20, 1969, and in Kirk, U.S. Pat. No. 3,380,122, issued Apr. 30, 1968, these patents being owned by the assignee of the instant application. Such prior art attachments comprise an object-penetrating part at one end thereof, an elongated filament-like section extending therefrom, and a part at the other end of said filament-like section which is enlarged relative to the thickness or diameter of said section. The object-penetrating part is designed to be passed through a hole (existing or made as part of the attaching operation) in the object with which it is to be associated, that part then remaining on the far side of said object, the elongated section passing through the hole, and the enlarged part remaining on the near side of the object. The object-penetrating part is capable of passing end-wise through said hole, but after it has passed therethrough it will assume its normal position substantially perpendicular to the elongated section and thereby prevent the attachment from escaping in one direction from the object in question. Escapement of the attachment in the other direction is prevented by the enlarged portion.

As is disclosed in the cited patents, attachments of the type in question are generally provided in the form of an assembly or "clip" of a plurality of such attachments — a typical clip includes 20 attachments. An attaching device or "gun" such as is disclosed in Bone U.S. Pat. No. 3,103,666, issued Sept. 16, 1963, and owned by the assignee of this application, may be employed to form the hole through the object with which the attachment is to be associated, sever a single attachment from the assembly of attachments, and force its object-penetrating part through the hole which it forms in the object in question and to the far side of that object.

Attachments of the type in question used in conjunction with attaching devices such as those shown in the Bone U.S. Pat. No. 3,103,666 patent have become extremely widely used in industry, not only for the attachment of tags and labels to articles to be sold on the retail market, where the attachments are particularly effective in preventing unscrupulous shoppers from switching tags — removing a tag from a low-priced article, attaching it to a high-priced article, and then paying only the lower price for the article — but also for securing any group of objects to one another. The attachments in question, particularly when used in connection with attaching devices of the type described, may be operatively applied at an extremely rapid rate even by relatively unskilled personnel, thus greatly reducing the cost of tagging, labeling, and securing objects to one another in general. Indeed, in many commercial areas attachments of the type in question have virtually supplanted all other attaching methods.

While such attachments have been widely used and, indeed, have been exceedingly effective in preventing tag switching, the fact that both ends of the attachment are exposed raises the possibility that a new scheme might be devised for switching tags from a low-priced article to a higher-priced article. For example, an unscrupulous shopper given sufficient time might be able to place the cross bar adjacent the filament and then thread the two back through the opening in the garment initially formed by the needle and through the tag and thereafter make any desired substitution. Accordingly, the need exists for a self-contained attachment whereby the ends of the filament are interlocked. In this manner, the only way the attachment could be removed from an object would be by actual breaking of the filament section, thereby preventing its subsequent use and providing a clear indication of tampering.

Furthermore, the basic filament type attachments have not provided multifunctional use as, for example, by being able to simultaneously function as hanging means for articles which are to be displayed in a hanging position, such as scarves, handkerchiefs and the like, it being necessary to resort to attachments of the filament and socket type or of the split filament type for this characteristic. Accordingly, it would be beneficial to provide attachments of the basic filament type which exhibit a more versatile functionality.

It is the prime object of this invention to modify the construction of a filament type attachment so as to permit the interlocking of the respective ends thereof.

It is a further object to replace the enlarged end of the attachment with a hollow body member having an opening therein adapted to receive the object-penetrating part.

It is still a further object to provide the opening with a plurality of projections to facilitate retention of the object penetrating part in the hollow body member.

It is another object to combine the individual attachments so as to facilitate their use with automated attaching devices.

It is still another object to provide an attachment which can be manufactured and assembled by means of simple, inexpensive machinery operations.

To these ends, the present invention provides an attachment comprising a filament having a laterally oriented bar at one end and a hollow body member at its other end. The body member has an opening in at least one wall thereof, the opening having dimensions relative to those of the bar such that the bar and the filament when oriented in a generally parallel relationship are passable through the opening into the interior of the hollow member. Furthermore, the hollow interior has a greater width than that of the opening, thereby defining an abutment which serves to retain the bar in the hollow interior when it is no longer in parallel orientation relative to the filament. Optionally, a plurality of projections extending into the opening may be provided in order to aid in stripping the bar from the insertion mechanism and thereafter to further facilitate retention of the bar in the hollow body member. The ability to insert the bar end of the filament into the body end thereof thus provides a self-contained, interlocking device wherein both ends of the filament are no longer exposed and thus not available to be tampered with.

The attachments may be combined into an integral assembly by conventional techniques, this permitting their insertion by means of automatic attaching devices. For example, when using the device of the aforementioned Bone U.S. Pat. No. 3,103,666 patent, the assembly of attachments are fed therethrough such that the cross bars of adjacent attachments are brought successively into register with the base of a hollow needle. The thus positioned attachment is then severed from the assembly and a plunger is effective to drive the cross bar through the needle with the filament projecting laterally through the slot. By inserting the needle through an object and a tag and then through the opening in the body member into the interior thereof, the cross bar likewise is inserted therethrough with the filament being bent over the trailing portion of the bar. Upon removal of the needle, the cross bar is effectively retained in the body member while the object and tag are maintained on the filament.

As a further advantage, the resulting looped configuration of the interlocked construction may be utilized for a variety of applications such as mounting loops for articles to be displayed in a hanging position, as hanger loops for skirts, and for other uses which will be apparent to the practitioner. The attachments are thus provided with greater application versatility.

To the accomplishment of the above, and to such other objects as may hereinafter appear, the present invention relates to an attachment and assembly of attachments as defined in the appended claims and as described in this specification, taken together with the accompanying enlarged drawings, in which:

FIG. 8 is a cross sectional view taken along line 8—8 of FIG. 7;

FIG. 9 is a perspective view of a third embodiment of a body member of this invention; and FIG. 10 is a fragmentary view in elevation of the wall of the member of FIG. 9 showing the bar-receiving opening, the projections and the abutment wall.

Figure 1:
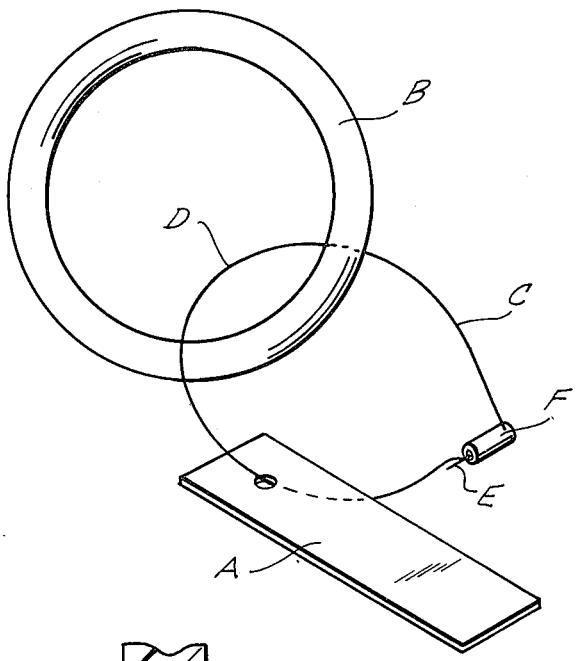
FIG. 1 is a perspective view showing a tag and the interlocked attachment of the present invention secured to an object.
Figure 3:
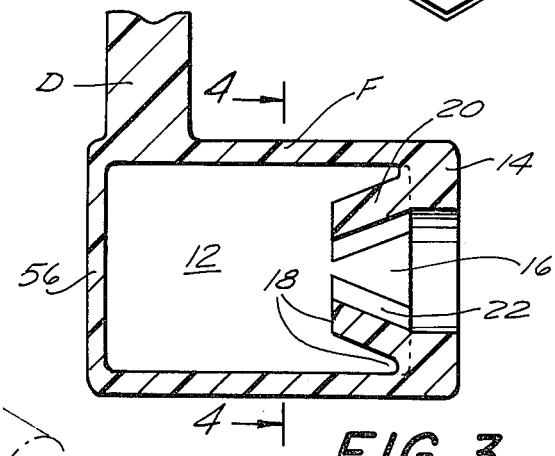
FIG. 3 is a cross sectional view taken along line 3—3 of FIG. 2 depicting an embodiment of a hollow body member.
Figure 4:
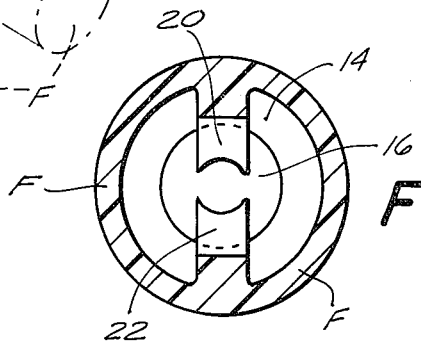
FIG. 4 is a cross sectional view taken along line 4—4 of FIG. 3 showing one embodiment of a bar-retaining projection.

As is shown in FIG. 1, a tag generally designated A is adapted to be secured to an article of merchandise generally designated B by means of an attaching device generally designated C, the attaching device C being reliably secured to tag A and being engageable with the article of merchandise B by having a filament portion generally designated D which is adapted to be passed through an appropriate part of the merchandise B, either through a pre-existing hole in article B (as shown) or through a self-made hole. The end of the filament D is provided with a laterally oriented bar generally designated E which is adapted to be passed into and permanently received in a hollow body member generally designated F at the other end of filament D, thus making permanent and interlocking the filament loop D which passes through and supports tag A and article B.

In the specific embodiment depicted in FIGS. 2–5, the attachment C comprises an elongated filament D, a normally laterally oriented bar E at one end thereof and a hollow body member F at the other end thereof. Cross bar E is illustrated as a relatively thin cylinder connected at its midpoint to filament D and extending generally at right angles to said filament D to form therewith a generally T-shaped configuration. (see FIG. 2) The cross bar E is shown as having a circular cross section but various other shapes may be suitable. In operation, as will be described in more detail hereinafter, the cross bar E is inserted through a tag A and/or an object B and into body member F along its axial direction, the retention of cross bar E in body member F thereby forming filament loop D which serves to retain tag A and/or object B. Accordingly, cross bar E must have a sufficient maximum length to width ratio to effectively prevent its extrication from body member F, for if bar E did come out from body member F tag A and/or object B would slip off filament D. In addition, cross bar E must have a sufficiently small effective cross section to allow it to be threaded through object B without producing a sizeable or noticeable hole therein.

Figure 5:
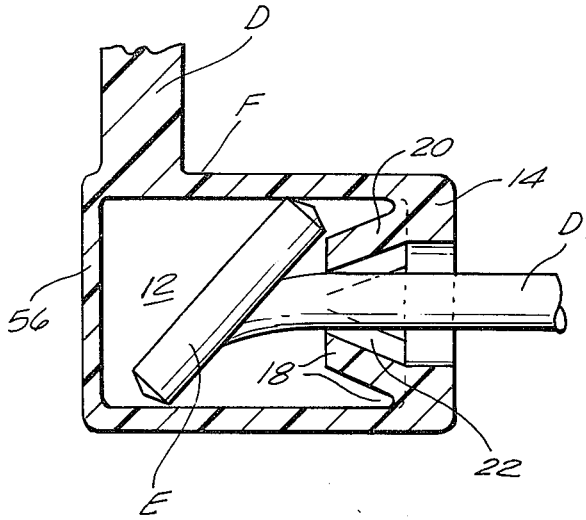
FIG. 5 is a cross sectional view of the body member of FIG. 3 depicting the retention of the cross bar therein.

Body member F, which is situated at the end of filament D opposite to said cross bar E, is seen to have a hollow interior 12. It is also seen that at least one wall 14 of said body member F has an opening 16 therethrough, leading into hollow interior 12. In all cases, hollow interior 12 has a greater width than opening 16 thereby permitting the remainder of the wall 14 to function as an abutment 18 between said interior 12 and said opening 16. Furthermore, the maximum width of said opening 16 is less than the length of cross bar E. With these dimensional relationships, cross bar E is passable through said opening 16 when said bar E is oriented in a direction generally parallel to the axis of opening 16, but when said bar E is in another direction while in said hollow interior 12 it engages with said abutment 18, thereby preventing its extrication from hollow interior 12. (FIG. 5)

Figure 2:
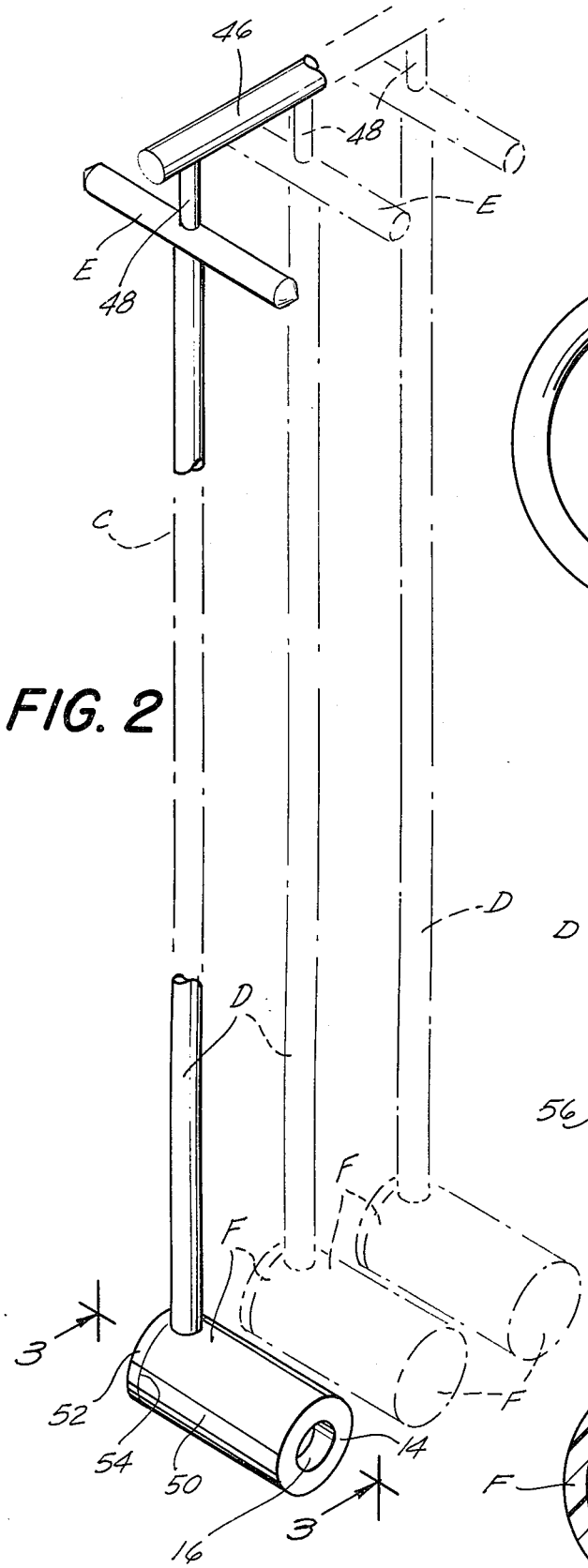
FIG. 2 is a perspective view of the attachment assembly of this invention showing the component parts of the individual attachments thereof.

The configuration of body member F and opening 16 may vary in accordance with the practitioner's requirements. Thus, a wide variety of geometrical shapes are applicable, while the opening may appear in any wall of the body member and preferably in an end wall. For example, FIG. 2 illustrates a cylindrical body member F having an opening 16 in one of its end walls 14. It is further seen in FIGS. 3 and 4 that a plurality of projections 20, 22 extend generally laterally into said opening 16 from the wall 14 surrounding said opening 16. Projections 20, 22 serve to facilitate the ejection of cross bar E and filament D from the penetrating needle into said hollow interior 12 and thereafter aid in the retention of bar E in that interior 12. Thus, as seen in FIG. 5, when bar E is inserted into hollow interior 12 of body member F, the slightest position change of bar E away from a generally parallel conformation causes bar E to engage projections 20, 22 thereby aiding in its removal from the needle and providing an abutment 18 engageable by bar E and preventing the extrication of bar E from hollow interior 12.

Figure 6:
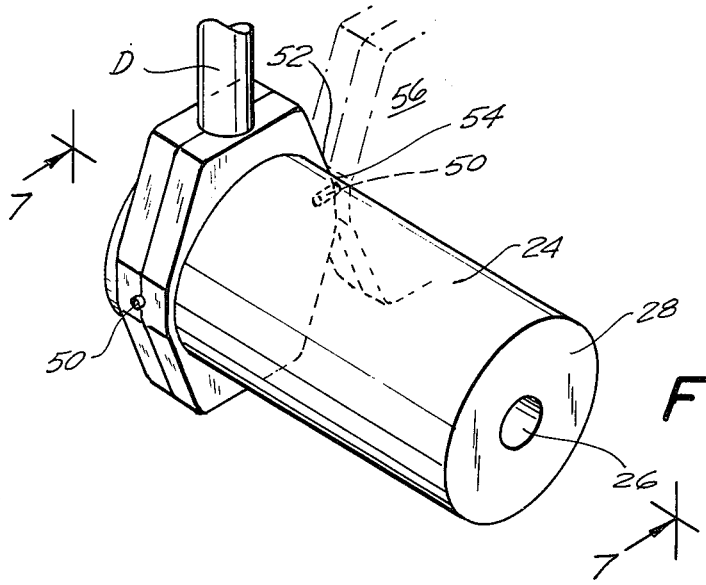
FIG. 6 is a perspective view of a second embodiment of a body member of this invention showing, in addition, means for securing adjacent body members of an attachment assembly.
Figure 7:
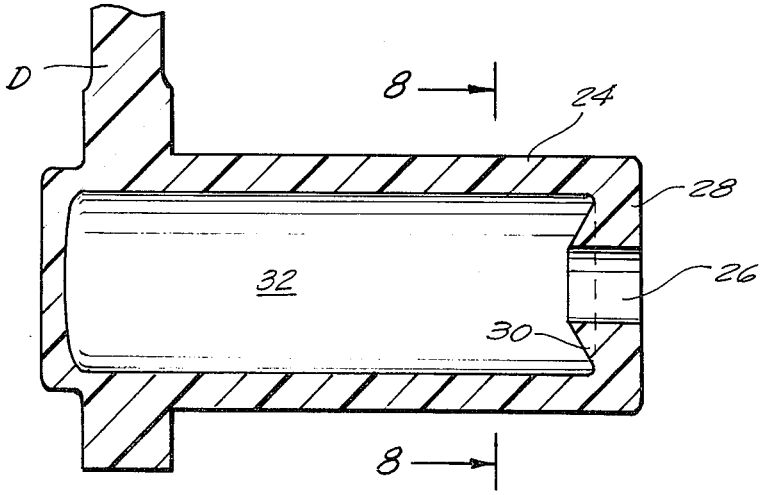
FIG. 7 is a cross sectional view taken along line 7—7 of FIG. 6.

A second embodiment of a body member of this invention is illustrated in FIGS. 6–8. In this instance body member 24 is again in cylindrical configuration having an opening 26 in one of its end walls 28. However, as distinguished from the embodiment in FIG. 2, opening 26 does not exhibit any projections (see FIG. 8). Accordingly, abutment 30 is formed by the remainder of end wall 28, this relationship being established by providing hollow interior 32 with a greater width than said opening 26. Any movement of bar E from its generally parallel position, subsequent to insertion into hollow interior 32, results in bar E engaging abutment 30, thereby preventing the extrication of bar E.

A third embodiment of a body member of this invention is depicted in FIGS. 9 and 10. In this instance body member 34 is seen to exhibit a rectangular configuration having an opening 36 in one of its end walls 38. As seen in FIG. 10, opening 36 contains projections 40, 42, 44 extending laterally into said opening 36 from wall 38 surrounding said opening 36. In this instance, a slight position change in bar E will enable it to engage projections 40, 42, 44 and thereby be prevented from slipping through opening 36.

As shown in FIG. 2, a plurality of attachments C are integrally molded together in an assembly strung along mounting rod 46 by means of necks 48. Thus, the laterally oriented bar E on each attachment C is secured to the rod 46 by means of a frangible neck 48 which can be readily severed during insertion of the attachment C. This construction is particularly well suited for use with attaching devices of the Bone U.S. Pat. No. 3,103,666 variety, inasmuch as a single actuation of the device can rapidly sever attachment C, insert the filament D and cross bar E through a tag and/or an object, and pass filament D and cross bar E into the interior of hollow body member F.

The attachments may be molded as a two piece construction wherein the cross bar, the filament and one hollow section of the body member are integrally connected while the second hollow section of the body member is separately molded. The two sections of the body member may be manufactured in two separate molds and thereafter combined by means of ultrasonic welding, solvent treatment, or cementing. Alternatively, the two sections could be prepared in a single mold connected by a "living" hinge, i.e. a hinge that will not split under constant flexing, and then combined as above. The open outer end of one of the sections is sealed, as by heat sealing or by providing a flap construction which can be closed over the open end in order to provide an enclosed receptacle for the cross bar, the sealing being conducted either prior or subsequent to combination of the individual sections. Reference may be made to FIG. 2 for an illustration of the combined body member. Thus, section 50, which was integrally molded with filament D and cross bar E, and section 52, which was separately molded are combined at 54 to provide a one piece, hollow body member F, the juncture line 54 being generally perpendicular to the axis of opening 16. In order to provide a totally enclosed body member F, the open outer end of section 52 was heat sealed to form wall 56 (see FIG. 3).

The attachments are preferably molded of a thermoplastic material such as Nylon and the like. In a typical embodiment the filament D extends approximately six inches in length, the bar E is approximately 13/32 inch in length and 0.045 inch in diameter, and body member F has an interior width of approximately ⅛ inch while the width of the opening is approximately 0.063 inch. It should be noted, however, that these dimensions may be varied considerably, depending upon the particular attachment and its specific end use application.

The manner of use and functioning of the attachments described herein will now be apparent. The assembly of FIG. 2 is inserted into an automatic tag attachment mechanism of the type described in the aforementioned Bone patent and the cross bars E are successively aligned with the hollow needle at its base. The needle passes through tag A, passes through an opening in object B or through object B itself if no pre-existing opening is found therein, and is then inserted through opening 16 into the interior 12 of body member F. As the attaching device is actuated, the thus positioned attachment C is severed from the assembly at its neck portion 48 and the cross bar E is forced through the needle and consequently through tag A, object B and into interior 12 of body member F by a plunger, the filament D projecting laterally outwardly through the axial extending slot in the needle. As cross bar E moves past tag A, object B and opening 16, the filament D is pulled inwardly toward the needle and is bent substantially 90° onto the trailing portion of cross bar E. As cross bar E leaves the needle, it tends to spring back to the T-configuration in relation to the filament D. Cross bar E, having moved from its generally parallel configuration, will thus engage abutment 18 and/or projections 20, 22 and thus will be retained in hollow interior 12 of body member F. It should be noted that in view of the generally small dimensions of hollow interior 12, cross bar E may occasionally remain in the needle and therefore be withdrawn from interior 12 as the needle is withdrawn. In such an instance, projections 20, 22 are particularly useful as means for aiding in the extrication of cross bar E from the needle. Thus, projections 20, 22 will engage even the slightest portion of cross bar E that extends from the needle, thereby exposing additional surface of cross bar E with which it may engage abutment 18 and be retained in interior 12. Likewise, either of projections 20, 22 may actually penetrate the axial extending slot in the needle, thereby engaging cross bar E therein and forcibly retaining it in interior 12 while the needle is withdrawn therefrom. The loop configuration which is thus formed may be of any circumferential length, depending upon the initial length of filament D. The loop thus functions to hold tag A and article B thereon. Furthermore, cross bar E is now completely concealed with body member F thereby removing the possibility of tampering or tag switching by manipulation of cross bar E.

As an optional feature, securing means may be interposed between and connected to adjacent body members in order to avoid tangling of individual attachments as by having the filaments intertwine with other filaments in a given assembly of attachments or in an adjacent assembly when a number of clips are packed or stored together. Reference may be made to U.S. application Ser. No. 256,890, filed May 25, 1972 issued as U.S. Pat. No. 3,733,657 on May 22, 1973 and assigned to the assignee of the instant application for a detailed description of the use of such securing means. In general, the securing means are sufficiently strong to maintain the attachments in proper orientation under normal conditions of storage and manipulation, but are readily frangible so that a given attachment, when used for its designated purpose, can be separated from the assembly at the body member end while leaving the other attachments well secured to one another. While the attachments remain secured at both ends they tend to remain substantially parallel to one another. However, when a particular attachment has been separated at the cross bar it is free to be moved relative to the other attachments remaining in the clip. Accordingly, it has been found advantageous to use securing means which resist tension forces relatively strongly but resist torsion forces relatively weakly so as to remain secured during manipulation of the attachment but being readily separable thereafter merely by a twisting movement. A thin and short filamentary connection has this characteristic. So does a layer of relatively weak adhesive.

The use of such securing means is depicted in FIG. 6. In this instance, a short, thin filamentary connection 50 secures facing surfaces 52, 54 of body members 24, 56, respectively. Connection 50 can be integrally molded with other portions of the attachment assembly, it merely being required to provide cavities in the mold for these additional components. The connection 50 is formed of material sufficiently tough to withstand tension or such bending as it may be subjected to. By reason of the shortness of that filament, however, it can be broken relatively readily when twisted. Alternately, assemblies may be made in the fashion of the prior art with the body members being moved into engagement with one another and there secured by means of a weak adhesive.

By means of the construction of the present invention attachments may be formed with substantially the same facility as is the case with comparable attachments now on the market. The instant attachments will have the advantage, however, of containing a hollow body member having an opening therethrough adapted to receive the cross bar component of the attachment, thereby providing a self-contained, interlocked system having no exposed ends available for tampering or manipulation.

While the invention has been described in terms of the specific embodiments herein, it should be apparent that variations may be developed without departing from the spirit or scope of the invention as defined by the following claims:

We claim:

1. An attaching device comprising a filament having a normally laterally oriented bar at one end and a hollow body member at its other end, at least one wall of said body member having an opening therethrough leading into the hollow interior of said member, said hollow interior having a greater width than said opening, an abutment defined therebetween, said filament being passable through said opening and said bar having a length greater than the maximum width of said opening and a thickness such that it is passable through said opening when said bar is oriented in a direction generally parallel to said filament, said bar when in a direction other than generally parallel to said filament being receivable in said hollow interior and engageable with said abutment, said body member comprising a two piece assembly wherein said pieces are secured to one another, one of said pieces being integrally connected to said filament, with one piece being an open-ended tube and the other piece being a closed-ended tube.

2. The attachment of claim 1, wherein said laterally oriented bar extends substantially at right angles to said filament.

3. The attachment of claim 2, wherein a plurality of projections extend laterally into said opening from the wall surrounding said opening to facilitate retention of said bar in said hollow interior.

4. The attachment of claim 3, which is constituted by a molded plastic assembly.

5. The attachment of claim 1, wherein a plurality of projections extend laterally into said opening from the wall surrounding said opening to facilitate retention of said bar in said hollow interior.

6. The attachment of claim 1, which is constituted by a molded plastic assembly.

7. The attachment of claim 1, wherein said pieces are connected along a line generally perpendicular to the axis of said opening.

8. An assembly of a plurality of attachments, each attachment comprising a filament having a normally laterally oriented bar at one end and a hollow member at its other end, at least one wall of said body member having an opening therethrough leading into the hollow interior of said member, said hollow interior having a greater width than said opening, an abutment defined therebetween, said filament being passable through said opening and said bar having a length greater than the maximum width of said opening and thickness such that it is passable through said opening when said bar is oriented in a direction generally parallel to said filament, said bar when in a direction other than generally parallel to said filament being receivable in said hollow interior and engageable with said abutment; said assembly comprising a mounting element and a connector between said mounting element and each laterally oriented bar, whereby said bar is connected to said mounting element.

9. The assembly of claim 7, wherein a plurality of projections extend laterally into said opening from the wall surrounding said opening to facilitate retention of said bar in said hollow interior.

10. The assembly of claim 8, wherein securing means are interposed between and connected to said body members to secure said members together, said securing means being comparatively more readily severable than said frangible means.

11. The assembly of claim 10, wherein said body members are arranged essentially parallel to one another with facing surfaces, said securing means being interposed between and secured to said facing surfaces.

12. The assembly of claim 8, wherein the body members are connected together.

13. The assembly of claim 12, wherein the body members are interconnected by means interposed therebetween.

14. An attachment device comprising a filamentary member, a flexible and laterally oriented bar at one end of said filamentary member and a body member at the other end of said filamentary member, said body member having an opening therein leading into a hollow interior having a width greater than said opening and an abutment defined therebetween, said filamentary member being passable through said opening and said bar having a length greater than the minimum width of said opening and a thickness such that it is passable through said opening into said hollow interior and engageable with said abutment therein when oriented in a direction generally parallel to said filamentary member.

* * * * *